United States Patent [19]

McCullough

[11] Patent Number: 4,702,006

[45] Date of Patent: Oct. 27, 1987

[54] HANDLE FOR THE HANDPIECE OF A MEAT TRIMMING KNIFE

[76] Inventor: Timothy J. McCullough, 833 Aurora Rd., Vermilion, Ohio 44089

[21] Appl. No.: 856,037

[22] Filed: Apr. 25, 1986

[51] Int. Cl.[4] ..... B26B 7/00

[52] U.S. Cl. ..... 30/276; 16/114 R; 16/DIG. 12; 30/329

[58] Field of Search ..... 30/276, 329, 340, 517–525; 16/111 R, 114 R, DIG. 12; 81/489

[56] References Cited

U.S. PATENT DOCUMENTS

| | | | |
|---|---|---|---|
| 1,506,510 | 8/1924 | Thuau . | |
| 1,928,718 | 10/1933 | Covey | 30/276 |
| 2,766,524 | 10/1956 | Dagneau | 30/215 |
| 3,093,172 | 6/1963 | Reed | 81/489 |
| 3,176,397 | 4/1965 | Schuhmann | 30/219 |
| 3,269,010 | 8/1960 | Bettcher | 30/276 |
| 3,605,841 | 9/1971 | Lindstrom et al. . | |
| 4,324,043 | 4/1982 | McCullough | 30/276 |
| 4,509,261 | 4/1985 | Bettlher | 30/276 |
| 4,575,938 | 3/1986 | McCullough | 30/276 |

FOREIGN PATENT DOCUMENTS 609236 10/1948 United Kingdom .

*Primary Examiner*—Douglas D. Watts

*Attorney, Agent, or Firm*—Michael Sand Co.

[57] ABSTRACT

A handle for the handpiece of a meat trimming knife is a one-piece tubular-shaped hollow member provided with a contour formed by three distinct annular sections. A center section has a concave cross-sectional configuration with one of the end sections having a cylindrical configuration and the other end section having a convex cross-sectional configuration. A series of circumferentially spaced longitudinally extending grooves are formed in the convex end section. The grooves are generally truncated V-shaped in cross section. The bore within the cylindrical end section is flared outwardly providing a gradually curved smooth surface engaged by a flexible drive cable to reduce fatigue on the cable as it extends into the bore of the handle for rotatably driving a ring knife mounted on a blade holder attached to the convex end of the tubular member by an annular coupler. The coupler is grooved similar to the convex section of the handle and has an annular collar attached to the front end which is formed with an outwardly flared flange which protects the fingers of an operator. The shape of the handle reduces the gripping force heretofore required to prevent slipping of the handpiece in an operator's hand thereby reducing fatigue on the operator's hand.

25 Claims, 11 Drawing Figures

HANDLE FOR THE HANDPIECE OF A MEAT TRIMMING KNIFE

TECHNICAL FIELD

The invention relates to meat cutting devices and in particularly to a power driven meat cutting tool adapted to be manually held and manipulated for the quick and easy removal of meat from carcasses and bones. More particularly, the invention relates to an improved handle for the handpiece of such a trimming knife which provides for a better grip on the handpiece and which reduces the fatigue on the hand of an operator using the cutting tool.

BACKGROUND ART

Various styles of power driven meat cutting tools have been devised wherein a power driven ring blade is rotatably mounted on a holder which in turn is mounted on a manually operated handpiece having a handle at one end thereof which is gripped and manipulated by an operator. These tools have been used for some time to facilitate the removal of meat from a carcass, primarily in a trimming operation or for removing the meat remains from the bones of an animal. These meat cutting tools are either electrically driven or pneumatic driven. Some examples of such electric meat cutting tools are shown in U.S. Pat. Nos. 3,024,532; 3,269,010; 3,461,557; 3,605,841; 4,494,311; and 4,575,938.

These electrically driven tools generally consist of a tubular shaped handpiece having a rear handle portion and a front body portion, with an annular blade holder being attached to the front portion of the handpiece with a ring blade being removably mounted thereon by various mounting arrangements. The blade is formed with gear teeth which are in driving engagement with the pinion gear mounted within the end of the handpiece. A flexible cable extends from a motor located adjacent to the work area and enters the rear of the handle and extends therethrough and is connected by a driving connection to the pinion gear. The cable is surrounded by a flexible casing which terminates within the handpiece or tubular body at a ferrel or similar connector.

Although these prior handpieces perform satisfactorily, it is desirable that as much comfort as possible be provided for the operator of the trimming knives. These knives are used in a cold environment over prolonged periods of time and ultimately results in fatigue to the hand of the operator thereby resulting in lower production. Furthermore, these trimming knives, and in particular the handle portions thereof, become coated with grease and slippery meat particles from the animal carcasses being trimmed making the handles difficult to grip requiring a greater pressure to be exerted thereon by the operator to insure a tight grip and to prevent the handpiece from turning in the operator's hand. The handpieces have a natural tendency to rotate in the operator's hand due to the natural rotational force of the rotating blade cutting into the meat causing an opposite twisting and turning reaction on the handle. As a consequence, the operator grips the handpiece even tighter to prevent this counter rotation and to overcome the slipperiness caused by the accumulating meat particles and grease on the handpiece which makes it still more difficult to grip the handpiece satisfactory. Likewise, it is desirable to increase the safety of the handpieces in any way possible and prevent or materially reduce the possibility of injury to an operator thereof.

Prior handles for such meat trimming knives have a relatively uniform cylindrical shape which are bulky and difficult for the operator to firmly grip over an extended period of time thereby increasing the fatigue on the operator's hand. Furthermore, it is difficult to provide a separate covering for the handpiece, such a rubber covering, to reduce the fatigue on the operator's hand since such coverings are subject to the accumulation of meat particles and grease making them difficult to clean for maintaining the required sanitary condition for the knives.

Other meat trimming knives such as shown in U.K. Pat. No. 679,236 and U.S. Pat. Nos. 2,766,524; 3,176,397; and 3,605,841 are formed with either a series of grooves or raised ribs extending axially along the handle or in a circular fashion thereabout to attempt to improve the operator's grip on the handle to reduce slippage and fatigue. Others have tried to increase the gripping effectiveness of the knife handle by placing a series of drilled holes throughout the handpiece or providing a knurled gripping surfaces. However, these increase considerably the difficulty of maintaining the cleanliness of the knife due to the difficulty of removing the trapped meat particles and grease from the holes and knurled surface at the end of each work period. Furthermore, these recesses and holes become quickly filled with the meat particles and grease reducing their effectiveness.

Therefore the need has existed for an improved handle for the handpiece of a meat trimming knife which reduces the fatigue on the operator's hand by providing a more comfortable handle contour and by reducing the accumulation of meat particles and grease which heretofore necessitated an increase in the operator's gripping of the handle to prevent rotation of the handle during operation of the trimming knife.

DISCLOSURE OF THE INVENTION

Objectives of the invention include providing an improved handle for the handpiece of a meat trimming knife of the type having an annular blade holder mounted on one end of the handpiece for rotatably mounting a ring blade thereon which is driven by a flexible, electrically driven cable which enters the rear of the handpiece handle and extends therethrough for driving connection with a pinion gear which engages and drives the ring blade. A further objective is to provide such an improved handle which has a slimmer design than prior handles and has a plurality of longitudinally extending grooves circumferentially spaced about a convexly curved annular front portion of the handle; in which the bottom of the grooves are narrower than the top openings thereby reducing the accumulation of meat particles in the grooves which heretofore resulted in slippery handles; in which the middle portion of the handle has a smooth concave annular configuration into which the fatty part of an individual's hand rests to provide a more comfortable grip on the handle; and in which the rear portion of the handle is belled outwardly from the concave portion to assist in preventing the handle from slipping from an operator's hand and to provide sufficient material in the wall of the handle for forming an internal bore having a constant relatively large radius at the rear portion of the handle to reduce the fatigue on the drive cable throughout the continual movement of the handpiece.

Another objective of the invention is to provide such an improved handle for the handpiece of a meat trimming knife which is formed of a one-piece unit of a lightweight synthetic material such as a rigid plastic, which can be maintained in a sanitary condition, which is lighter-in-weight than prior all metal handle constructions, and which increases the comfort of the operator in a cold environment due to the insulating qualities of the plastic material.

A still further objective of the invention is to provide such a handle which is removably mounted on the blade holder portion of the meat trimming knife by an annular coupler, which has an annular blade guard mounted between the coupler and blade holder, having an outwardly flared flange at the front portion to increase the safety of the knife by providing a guard to prevent the index finger and/or thumb of the operator from slipping off the handle and into the rotating knife, in which the concave rear portion of the handpiece reduces fatigue on the little finger and wrist of the operator due to the fatty portion of the hand lying in the concave area; and in which the slimmer handle configuration is achieved without sacrificing the internal bore space required for attaching the power driven cable to the pinion gear which drives the ring knife.

Still another objective of the invention is to provide such an improved handle for the handpiece of a meat trimming knife which can be assembled and disassembled easily and conveniently for cleaning and maintenance together with the blade holder portion of the handpiece to provide a sanitary unit, which will eliminate discarding the entire handpiece when only parts thereof becomes damaged or excessively worn, and which provides an improved handle which achieves the desired results, which eliminates difficulties existing in the art and which solves problems, satisfies needs and obtains new results.

These objectives and advantages are obtained by the improved handle for the handpiece of a meat trimming knife of the type having an annular blade holder mounted on an end of the handpiece with an annular cutting blade rotatably mounted on said holder, wherein said improved handle of the invention, the general nature of which may be stated as including an elongated generally tubular-shaped hollow member having first and second ends and a central bore extending longitudinally between said ends with the blade holder being adapted to be mounted on said first end; said tubular shaped member having a central portion with a generally hyperbolic configuration formed integrally with and merging into an annular portion at one end thereof and into another end portion having a generally truncated ellipsoidial configuration, with said truncated ellipsoidial end portion being formed with a plurality of circumferentially spaced longitudinally extending grooves.

BRIEF DESCRIPTION OF THE DRAWINGS

A preferred embodiment of the invention, illustrative of the best mode in which applicant contemplates applying the principles is set forth in the following description and is shown in the drawings, and is particularly and distinctly pointed out and set forth in the appended claims.

Similar numerals refer to similar parts throughout the drawings.

BEST MODE FOR CARRYING OUT THE INVENTION

Figure 1:
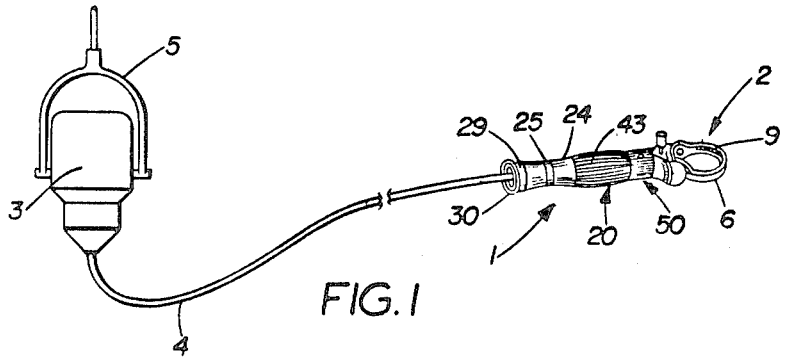
FIG. 1 is a generally diagrammatic perspective view showing a usual electrically driven meat cutting assembly of the type having the improved handpiece as a part of the meat trimming knife.
Figure 2:
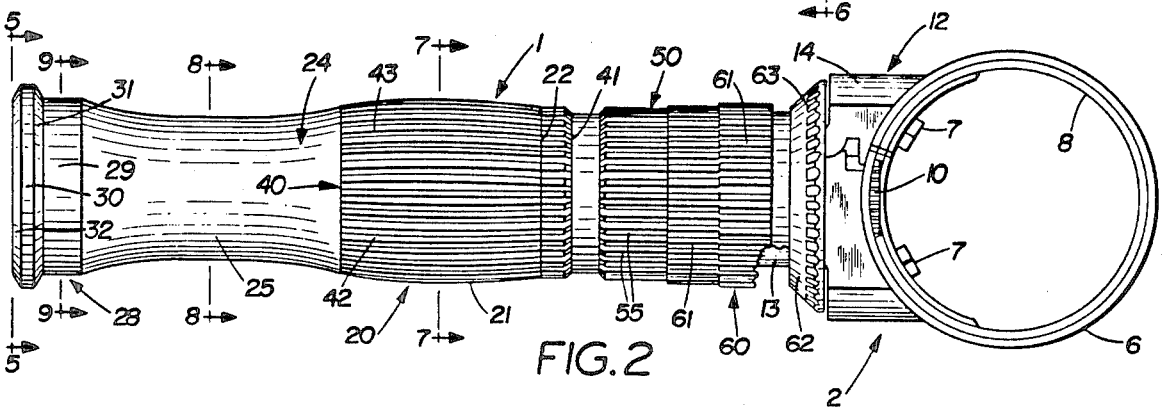
FIG. 2 is a bottom plan view of the improved handle forming part of a handpiece having a ring blade and blade holder mounted thereon.
Figure 3:
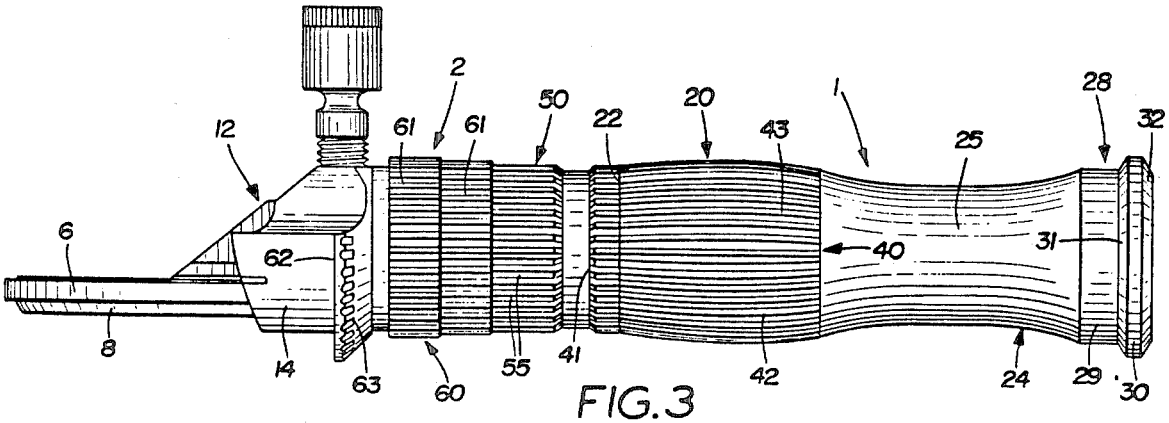
FIG. 3 is a side elevational view of the trimming knife shown in FIG. 2 having the improved handle as a part thereof.
Figure 5:
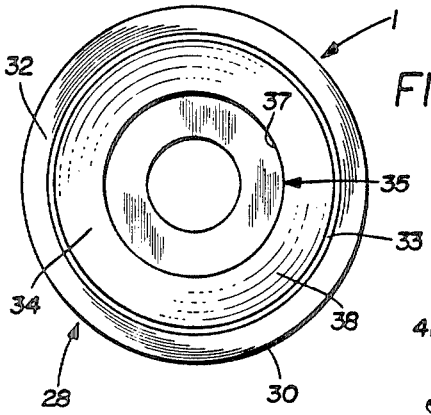
FIG. 5 is an enlarged and elevational view looking in the direction of arrows 5—5, FIG. 2.
Figure 6:
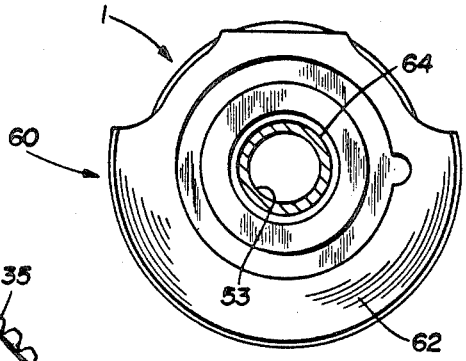
FIG. 6 is an enlarged sectional view taken on line 6—6, FIG. 2 with the blade holder removed and an inner ferrule shown in section.

The improved handle of the invention is indicated generally at 1, and is shown in FIG. 1 as a part of a handpiece indicated generally at 2, shown connected to an electric motor by a flexible drive cable 4. The electric motor is usually supported by a hanger 5 closely adjacent to the work table on which a meat trimming operation is being performed. A usual annular blade holder 6 is mounted on the front end of handpiece 2 by a pair of mounting screws 7 (FIG. 2). An annular cutting blade 8 is rotatably mounted on blade holder 6 and is provided with a plurality of gear teeth 9 which are formed about an upper edge of the blade and are drivingly connected to a pinion gear 10 rotatably mounted within the end of the handpiece. Examples of such a blade holder and ring gear are shown in U.S. Pat. Nos. 4,236,531; 4,324,043; 4,494,311; and 4,575,938.

Figure 4:
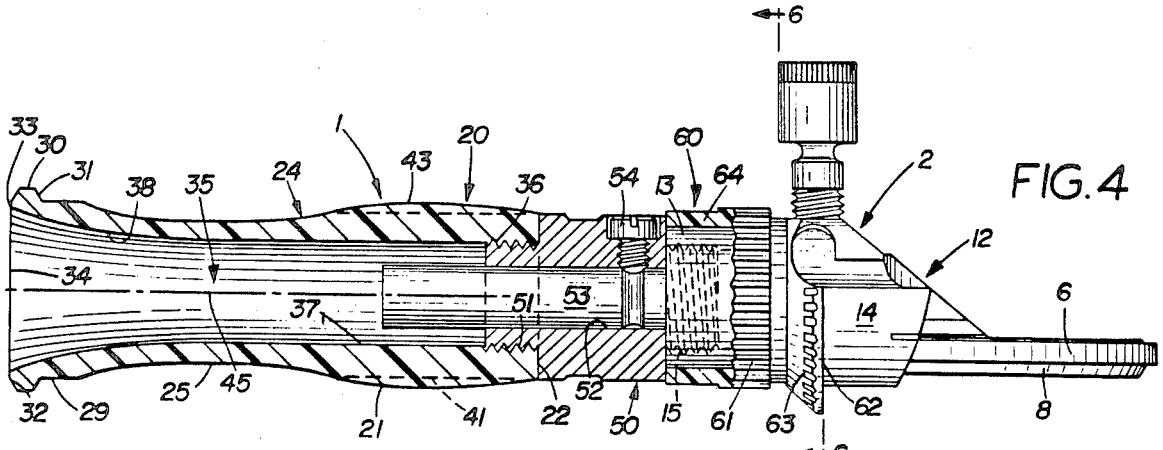
FIG. 4 is a view similar to FIG. 3 with portions broken away and in section.

A blade holder attachment portion 12 which is similar to the front portion of many prior art handpieces of the type shown in the above listed patents, consists of a tubular body 13 which terminates in an arcuate shaped blade attachment front portion 14 which provides for the support and attachment means for blade holder 6. Tubular body 13 is formed with an internally threaded central bore 15 as shown in FIG. 4.

Figure 11:
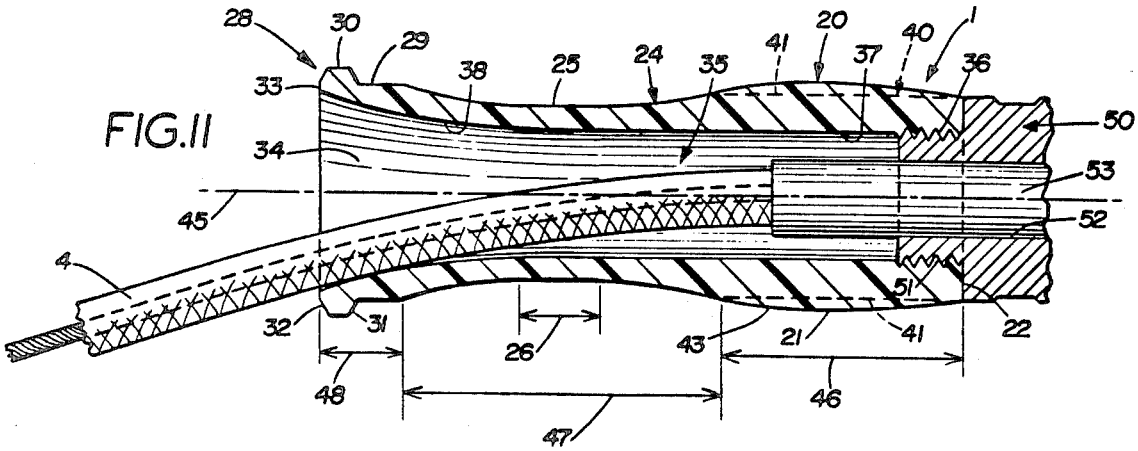
FIG. 11 is an enlarged fragmentary sectional view showing a flexible drive cable extending outwardly from the rear portion of the improved handle.

Improved handle 1 is an integral one-piece member, preferably formed of a synthetic material such as a rigid plastic, and has three distinct areas of contour. Handle 1 consists of a front section indicated generally at 20, which has a convex outer surface 21, and which has a generally truncated ellipsoidial configuration terminating in an annular front edge 22 (FIG. 11). Front section 20 merges into a concave intermediate section indicated generally at 24, which has a generally hyperbolic configuration except for a short axially extending cylindrical area 25 at the midpoint thereof, the length of which is specifically shown in FIG. 11 by arrow 26. Concave intermediate section 24 merges into a third or annular rear section indicated generally at 28. Rear section 28 has a first cylindrical surface 29 and a second cylindrical surface 30. Surface 30 is joined with cylindrical surface 29 by a conical surface 31, and terminates in another concial surface 32 which merges with an annular edge 33 forming open rear end 34 of handle 1.

A longitudinally extending axial bore indicated generally at 35, extends completely through improved handle 1 and has a internally threaded front portion 36 (FIGS. 4 and 11) and a cylindrical main portion 37 extending rearwardly therefrom which merges into a gradually continuously outwardly flared portion 38.

Figure 7:
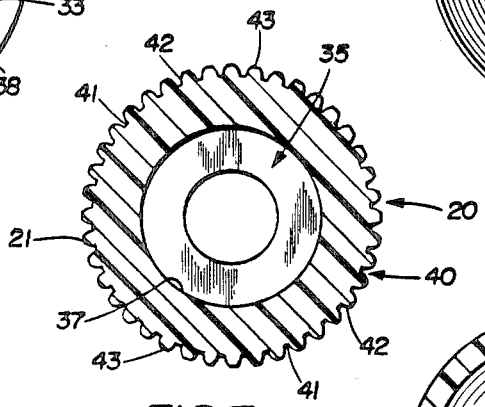
FIG. 7 is an enlarged sectional view taken on line 7—7, FIG. 2.
Figure 8:
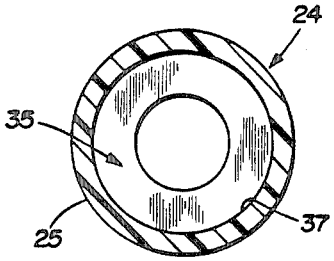
FIG. 8 is an enlarged sectional view taken on line 8—8, FIG. 2.
Figure 9:
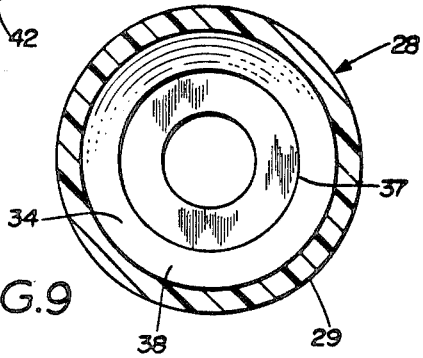
FIG. 9 is an enlarged sectional view taken on line 9—9, FIG. 2.
Figure 10:
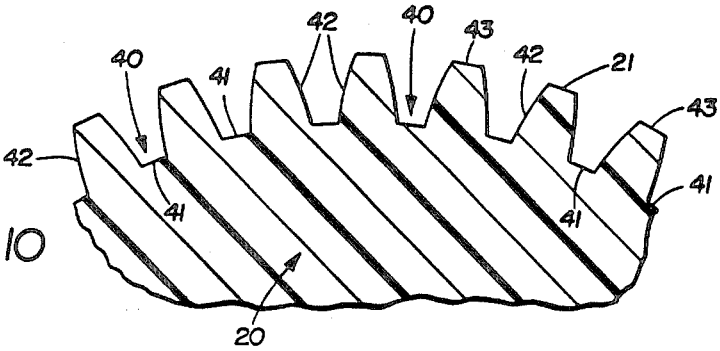
FIG. 10 is a greatly enlarged fragmentary view of a portion of the grooves of FIG. 7.

In accordance with one of the main features of improved handle 1, a plurality of longitudinally extending grooves indicated generally at 40, are formed in the convex outer surface 21 of front handle section 20 and extend in a circumferentially spaced relationship completely about front section 20 (FIGS. 7 and 10). Each groove 40 has a generally truncated V-shaped configuration with a longitudinally extending root base 41 and a pair of outwardly extending sidewalls 42. Sidewalls 42 preferably have a somewhat curved configuration although the same could be straight if desired without affecting the results achieved thereby. Grooves 40 form a plurality of circumferentially spaced intervening crests 43 which form convex outer surface 21. Root bases 41 extend longitudinally along and throughout front section 20 and as shown in FIGS. 4 and 11 are parallel with axial centerline 45 of handle 1.

The particular configuration of grooves 40 as shown in FIG. 10, is important in that the top groove openings being greater than the bottom openings or root bases 41 enables trapped meat particles and grease to be easily removed therefrom preventing their buildup, heretofore resulting in an outer slippery surface exposed to the hand of an operator.

Concave intermediate section 24 has a generally hyperbolic configuration, and is adapted to engage the fatty part of an operator's hand, and due to its reduced diameter with respect to convex front section 20, section 24 provides for an increased grip on the handle at the area of the wrist and little finger portion of the operator's hand. The third or rearmost section 28, in addition to restraining the rearward movement of the hand along the handle, strengthens the rear portion of the handle due to the stepped annular configuration shown by cylindrical surfaces 29 and 30.

Another feature of the invention is shown in FIG. 11. The gradually tapered outwardly flared bore rear section 38 provides for the smooth gradual exit of the cable from the handle which prevents the crimping or severe bending of cable 4 as occurs in prior handpiece constructions. This construction reduces considerably the fatigue on the cable increasing its lifespan.

In a preferred embodiment, handle 1 will have an overall length of approximately 4 inches with front section 20 having a length of approximately 1.43 inches or 35% of the total length (arrow 46); intermediate concave section 24 will have a length of approximately 2 inches or 50% of the total handle length (arrow 47); with the third and rearmost annular section 28 having a length of approximately 0.6 inches or approximately 15% of the total length of the handle (arrow 48). These dimensions can vary without affecting the concept of the invention although these lengths and the proportional relationships thereof to the overall handle length, are believed to provide the most effective results both for reducing the gripping force required by the operator to maintain the handle firmly in his grasp and for reducing fatigue.

The outer diameter of cylindrical surface 29 preferably is slightly larger than the diameter of an imaginary cylindrical surface generated by root bases 41 of grooves 40. Also, the outer diameter of cylindrical surface 30 of annular rear section 28 is larger than the outer diameter of the major diameter of crests 43 of grooves 40. Likewise, as shown in FIGS. 4 and 11, grooves 40 preferably extend throughout the longitudinal length of truncated front section 20, which section resembles a double truncated ellipsoidial body.

Improved handle 1 may also include a coupler indicated generally at 50, which has an externally threaded reduced cylindrical end portion 51 which threadably engages threaded portion 36 of handle front section 20, and has a smooth cylindrical bore 52 in which a ferrule 53 is mounted and retained by a set screw 54. Ferrule 53 receives the end of cable 4 therein and is described particularly in Pat. No. 4,324,043. Preferably a series of grooves 55 are formed in coupler 50 similar in cross-sectional configuration to that of grooves 40 to enhance the gripping of the handle by an operator.

A locking collar indicated at 60, is axially slidably mounted on the rear end portion of tubular body 13 for securing the arcuate blade attachment portion 14 in a locked position as shown and described in Pat. No. 4,575,938. Locking collar 60 also is formed with a plurality of longitudinally extending grooves 61 having a cross-sectional configuration similar to that of grooves 40. Collar 60 terminates in an outwardly flared end flange 62 formed with a plurality of serrations or indentations 63 which serves as a finger guard to prevent an operator's index finger and thumb from slipping off the end of the handle and into the rotating blade. Collar 60 includes an annular body 64 which is telescopically slidably mounted on the end of tubular body 13 as shown in FIG. 4.

Locking collar 60 and coupler 50 preferably are formed of lightweight aluminum and provide a forward continuation of handle 1 containing the improved groove configuration therein to improve the gripping of the handpiece by an operator and to prevent the accumulation of meat particles in the grooves by the unique configuration thereof, and which increases the ability to remove any trapped food particles from within the grooves.

The improved handle has a number of advantages over known handle constructions for meat trimming knives. One of the most important features is the formation of the axially extending grooves in the handle which have a shape wherein the bottom of the groove is smaller than the top to permit easy cleaning of the meat particles which become trapped therein, in addition to providing a surface which when gripped reduces considerably the slipping or twisting of the handle in the operator's hand. Another advantage is the shape of the handle including the concave intermediate section which tapers into the larger annular rear section which enables the fatty part of the operator's hand to fall into the concave smaller diameter intermediate portion with the larger rear section retaining the operator's hand generally within the concave section.

Another advantage is the gradually smooth outwardly flared bore located within the rear of the concave section and annular rear section which reduces the bending angle on the flexible drive cable which enters through the rear of the handle. A still other advantage is the outwardly flared flange formed at the end of the annular collar which serves as a guard preventing the operator's finger or thumb from sliding beyond the guard and into the revolving blade. Furthermore, the grooves formed in the annular coupler and collar increase the gripping action of the operator's hand throughout the entire length of the handpiece.

Another advantage is the formation of the handle as an integral lightweight member formed of a plastic material enabling it to be maintained in a sanitary condition and provides insulation for the operator's hand since it is used in a cold environment.

Accordingly, the improved handle is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved handle for the handpiece of a meat trimming knife is constructed and used, the characteristics of the construction, and the advantageous, new and useful results obtained; the new and useful structures, devices, elements, arrangements, parts, and combinations, are set forth in the appended claims.

What is claimed is:

1. An improved handle for a handpiece of a meat trimming knife of the type having an annular blade holder mounted on an end of the handpiece with an annular cutting blade rotatably mounted on said holder, said improved handle including an elongated generally tubular-shaped hollow member having first and second ends and a central bore extending longitudinally between said ends with the blade holder being adapted to be mounted on said first end; said tubular-shaped member having a central section with a generally hyperbolic configuration formed integrally with and merging into an annular section at one end thereof and into another end section having a generally truncated ellipsoidial configuration, with said truncated ellipsoidial end section being formed with a plurality of circumferentially spaced longitudinally extending grooves; said annular end section forming the second end of the tubular-shaped member and having first and second longitudinally extending cylindrical areas with said second cylindrical area having a larger diameter than said first cylindrical area and a larger diameter than that of the truncated ellipsoidial end section.

2. The improved handpiece defined in claim 1 in which the generally hyperbolic central section has a cylindrical portion in the center thereof.

3. The improved handpiece defined in claim 1 in which the annular end section forms the second end of the tubular-shaped member and has first and second longitudinally extending cylindrical areas with said second cylindrical area having a larger diameter than said first cylindrical area.

4. The improved handpiece defined in claim 1 in which the central bore has a cylindrical section comprising the majority of the bore length and an outwardly flared curved end section at the second end of the handle.

5. The improved handpiece defined in claim 4 in which the cylindrical section of the bore terminates in an internally threaded area at the first end of the handle.

6. The improved handpiece defined in claim 1 in which each of the grooves has a generally truncated cross-sectional configuration defined by a root and a pair of outwardly extending walls.

7. The improved handpiece defined in claim 6 in which the roots of grooves extend longitudinally along the truncated ellipsoidal portion of the tubular-shaped member parallel to the axis of member.

8. The improved handpiece defined in claim 7 in which the groove roots lie on an imaginary cylindrical surface, the diameter of which is less than the outer diameter of the annular portion of the tubular-shaped member.

9. The improved handpiece defined in claim 7 in which the sidewalls of the grooves have an outwardly curved configurations.

10. The improved handpiece defined in claim 1 in which the central section, annular end section and truncated ellipsoidial end section of the tubular-shaped member comprises approximately 50%, 15% and 35%, respectively, of the total length of said member.

11. The improved handpiece defined in claim 1 in which the tubular-shaped member is a one-piece member formed of a rigid plastic material.

12. The improved handpiece defined in claim 1 in which coupler means is threadably mounted on the second end of the tubular-shaped member for mounting the blade holder on said member.

13. The improved handpiece defined in claim 12 in which an annular collar is axially abuttingly engaged with the coupler means when the handle is attached to a blade holder; and in which the coupler means and collar are formed with circumferentially spaced longitudinally extending grooves in cylindrical outer surfaces thereof.

14. The improved handpiece defined in claim 13 in which the collar terminates in an outwardly flared flange.

15. An improved handle for the handpiece of a meat trimming knife comprising an elongated one-piece tubular-shaped hollow member having at least three distinct axially extending annular sections, with a first front section having a convex outer surface formed with a series of circumferentially spaced longitudinally extending grooves, with a second intermediate section having a concave outer surface, and with a third rear section having first and second cylindrical outer surfaces, with said second cylindrical outer surface having a larger diameter than said first cylindrical outer surface and larger than said first front section.

16. The improved handle defined in claim 15 in which the longitudinal grooves in the first section have a root and a pair of side walls forming a generally truncated V-shape in transverse cross-section.

17. The improved handle defined in claim 16 in which the groove roots lie on an imaginary cylindrical surface extending concentrically about a centerline of the tubular-shaped hollow member.

18. The improved handle defined in claim 15 in which the first, second and third sections comprise approximately 35%, 50% and 15% respectively, of the longitudinal length of the hollow member.

19. The improved handle defined in claim 15 in which the bore includes a cylindrical portion extending between the first and section section, and an outwardly flared portion extending between the second and third sections.

20. The improved handle defined in claim 15 in which an annular coupler is threadably mounted on an outer end of the first section for attaching a blade holder thereon; and in which said coupler is formed with longitudinal extending grooves.

21. An improved handle for a handpiece for a meat trimming knife of the type having an annular blade holder mounted on an end of the handpiece with an annular cutting blade rotatably mounted on said holder, said improved handle including an elongated generally tubular-shaped hollow member having first and second ends and a central bore extending longitudinally between said ends with the blade holder being adapted to be mounted on said first end; said tubular-shaped member having a central section with a generally hyperbolic configuration formed integrally with and merging into an annular section at one end thereof and into another end section having a generally truncated ellipsoidial configuration, with said truncated ellipsoidial end section being formed with a plurality of circumferentially spaced longitudinally extending grooves, each of said grooves having a generally truncated cross-sectional configuration defined by a root and a pair of outwardly extending walls, with the roots extending longitudinally along the truncated ellipsoidial portion of the tubular-shaped member paralled to the axis of said member, and said roots lying on an imaginary cylindrical surface, the diameter of which being less than the outer diameter of the annular portion of the tubular-shaped member.

22. An improved handle for a handpiece of a meat trimming knife of the type having an annular blade holder mounted on an end of the handpiece with an annular cutting blade rotatably mounted on said holder, said improved handle including an elongated generally tubular-shaped hollow member having first and second ends and a central bore extending longitudinally between said ends with the blade holder being adapted to be mounted on said first end; said tubular-shaped member having a central section with a generally hyperbolic configuration formed integrally with and merging into an annular section at one end thereof and into another end section having a generally truncated ellipsoidal configuration, with said truncated ellipsoidal end section being formed with a plurality of circumferentially spaced longitudinally extending grooves, said central section, annular end section and truncated ellipsoidal end section comprises approximately 50%, 15% and 35%, respectively of the total length of said tubular-shaped member.

23. An improved handle for a handpiece of a meat trimming knife of the type having an annular blade holder mounted on an end of the handpiece with an annular cutting blade rotatably mounted on said holder, said improved handle including an elongated generally tubular-shaped hollow member having first and second ends and a central bore extending longitudinally between said ends with the blade holder being adapted to be mounted on said first end; said tubular-shaped member having a central section with generally hyperbolic configurtion formed integrally with and merging into an annular section at one end thereof and into another end section having a generally truncated ellipsoidial configuration, with said truncated ellipsoidial end section being formed with plurality of circumferentially spaced longitudinally extending grooves; coupler means thereadably mounted on the second end of the tubular-shaped member for mounting the blade holder on said member; and an annular collar axially abutting engaged with the coupler means when the handle is attached to a blade holder, with said coupler means and collar being formed with circumferentially spaced longitudinally extending grooves in cylindrical outer surfaces thereof.

24. An improved handle for the handpiece of a meat trimming knife comprising an elongated one-piece tubular-shaped hollow member having at least three distinct axially extending annular sections, with a first section having a convex outer surface formed with a series of circumferentially spaced longitudinally extending grooves, with a second section having a concave outer surface, and with a third section having a cylindrical outer surface; said first, second and third sections comprising approximately 35%, 50% and 15% respectively, of the longitudinally length of the hollow member.

25. An improved handle for the handpiece of a meat trimming knife comprising an elongated one-piece tubular-shaped hollow member having at least three distinct axially extending annular sections, with a first section having a convex outer surface formed with a series of circumferentially spaced longitudinally extending grooves, with a second section having a concave outer surface, and with a third section having a cylindrical outer surface; and an annular coupler formed with longitudinally extending grooves being threadably mounted on an outer end of the first section for attaching a blade holder thereon.

* * * * *